US010626567B2

(12) United States Patent
Haggard

(10) Patent No.: US 10,626,567 B2
(45) Date of Patent: Apr. 21, 2020

(54) ABSORBENT SPREADER

(71) Applicant: Samuel Haggard, Independence, MO (US)

(72) Inventor: Samuel Haggard, Independence, MO (US)

( * ) Notice: Subject to any disclaimer, the term of this patent is extended or adjusted under 35 U.S.C. 154(b) by 0 days.

(21) Appl. No.: 15/660,553

(22) Filed: Jul. 26, 2017

(65) Prior Publication Data

US 2019/0119871 A1 Apr. 25, 2019

(51) Int. Cl.

| | |
|---|---|
| ***B05B 9/00*** | (2006.01) |
| ***E01H 1/00*** | (2006.01) |
| *E01H 10/00* | (2006.01) |
| *E01C 19/20* | (2006.01) |

(52) U.S. Cl.

CPC ..... *E01H 1/001* (2013.01); *E01C 19/2005* (2013.01); *E01C 2019/206* (2013.01); *E01H 10/007* (2013.01)

(58) Field of Classification Search

CPC ..... B05B 9/007; E01H 10/007; E01H 1/001; E01C 19/2005; E01C 2019/206; E01C 19/20; A01C 7/02; A01C 15/02; A01C 15/00

USPC ..... 222/608, 624, 623, 614

See application file for complete search history.

(56) References Cited

U.S. PATENT DOCUMENTS

| | | | | |
|---|---|---|---|---|
| 2,973,884 | A * | 3/1961 | West | A01C 7/085 222/625 |
| 3,173,165 | A * | 3/1965 | Speight | A47L 11/4088 401/21 |
| 3,208,094 | A * | 9/1965 | Pilkington | A47L 11/4066 401/48 |
| 5,294,060 | A * | 3/1994 | Thompson | A01C 15/02 222/145.7 |
| 6,471,431 | B1 * | 10/2002 | Jennings | A01C 15/02 222/623 |
| 8,011,120 | B1 * | 9/2011 | Hipple | E01C 19/203 239/659 |
| 9,233,382 | B2 * | 1/2016 | Ossian | E01H 5/04 |
| 2015/0059517 | A1 * | 3/2015 | Calloway | A01C 15/02 74/523 |
| 2017/0312777 | A1 * | 11/2017 | Fontaine | B05B 15/68 |
| 2018/0264511 | A1 * | 9/2018 | Wadkins | B05C 19/008 |

* cited by examiner

*Primary Examiner* — Paul R Durand
*Assistant Examiner* — Robert K Nichols, II
(74) *Attorney, Agent, or Firm* — The Iwashko Law Firm, PLLC; Lev Ivan Gabriel Iwashko

(57) ABSTRACT

The absorbent spreader is the only product of its kind that is specifically designed to make spreading maintenance absorbents a cleaner and faster task, saving consumers time and energy usually spent from traditional methods. The absorbent spreader is uniquely designed with a release button enabling users to precisely control where to drop the clay, ensuring no accidental messes or unnecessary waste of clay during task work.

7 Claims, 4 Drawing Sheets

ABSORBENT SPREADER

BACKGROUND OF THE INVENTION

Field of the Invention

The present invention is a hardware accessory. More specifically, the present invention is a spreader for laying down oil absorbents.

Description of the Related Art

There are currently no feasible products on the market that offer an easier way to spread maintenance absorbents on the ground. Composition clays are commonly used to remove fluids such as grease, hydraulic fluid, water and other spills from concrete floors. Such products are being manually dispersed by consumers, which can be time-consuming and exhausting.

SUMMARY OF THE INVENTION

The present invention is a transportable machine that efficiently distributes absorbents via its chute by spreading the absorbents.

The spreader includes a basket, a chute, wheels, a release button, brush, legs a handle grip, and a water-proof basket cover.

It is an object of the present invention to provide wheels that provide an effortless way to move the spreader covering surface areas rapidly.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
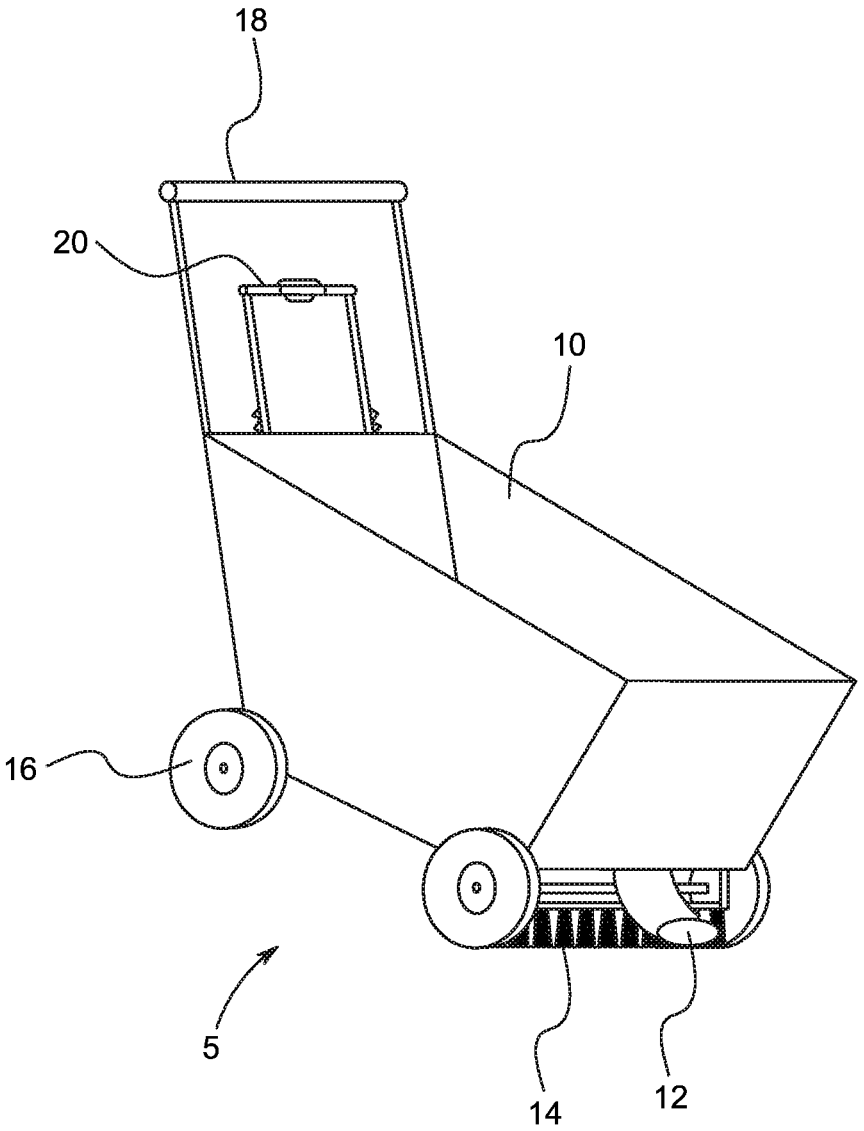
FIG. 1 illustrates a side view of an absorbent spreader, in accordance with one embodiment of the present invention.

Referring now to FIG. 1, illustrated is a side view of an absorbent spreader 5, in accordance with one embodiment of the present invention.

Figure 2:
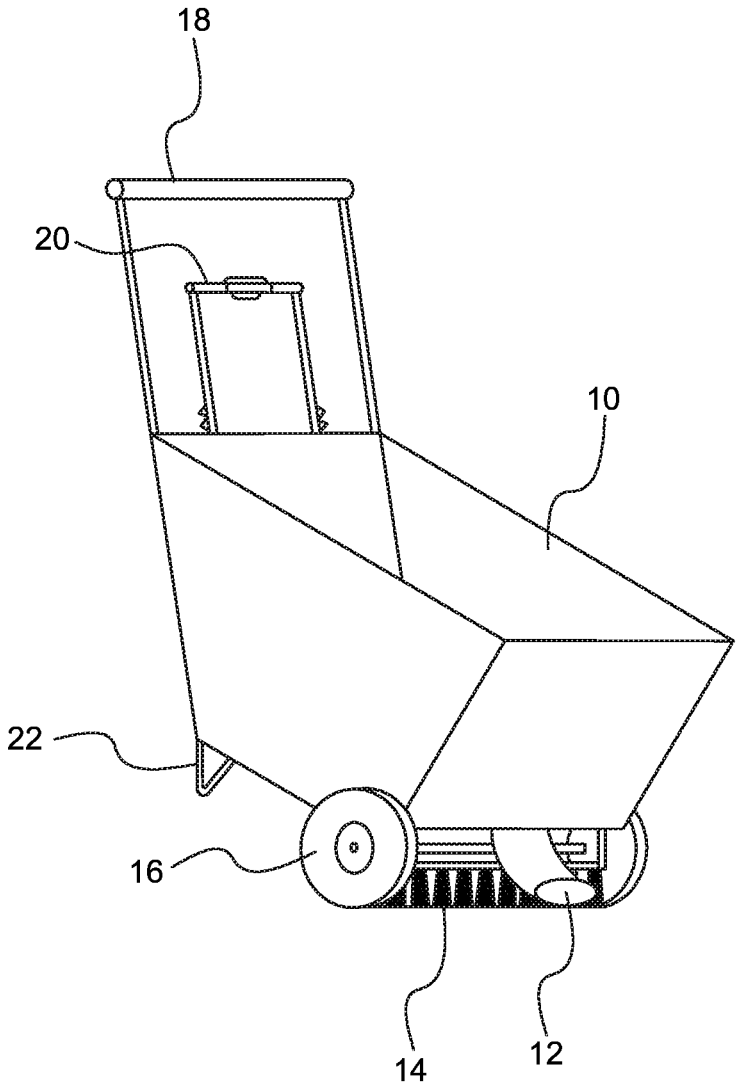
FIG. 2 illustrates a side view of an absorbent spreader, in accordance with another embodiment of the present invention.

In FIG. 1, illustrated is a side view of an absorbent spreader 5, including a basket 10, a chute 12, a brush 14, a wheel 16, a fold down handle 18, and an adjustable width handle 20. The basket 10 holds the absorbents. The chute 12 allows the absorbents to flow through. Referring now to FIG. 2, illustrated is a side view of an absorbent spreader 5, in accordance with another embodiment of the present invention.

In FIG. 2, illustrated is a side view of an absorbent spreader 5, including a basket 10, a chute 12, a brush 14, a wheel 16, a fold down handle 18, an adjustable width handle 20, and legs 22. The wheel 10 makes moving the spreader 5 easy and when the spreader 5 is no longer needed to spread the absorbents, the legs 22 that are attached to the basket 10 prevent the spreader from moving.

Figure 3:
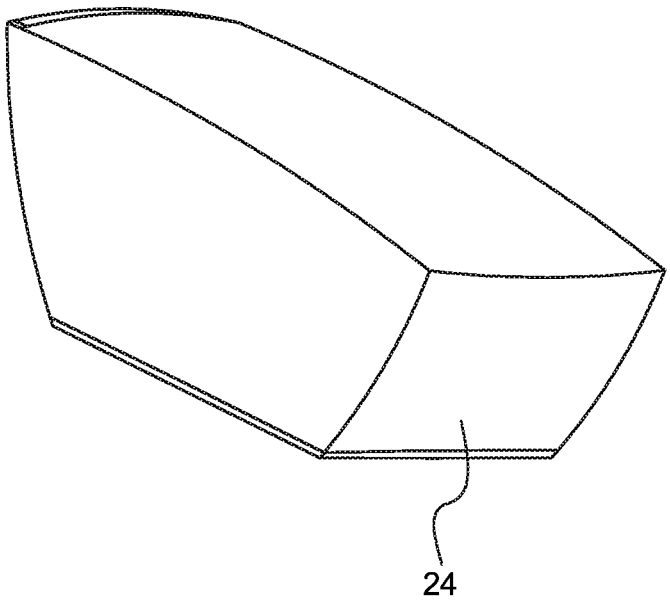
FIG. 3 illustrates a side view of a water-proof cover for the spreader, in accordance with another embodiment of the present invention.

Referring now to FIG. 3, illustrated is a side view of a water-proof cover for the spreader 24, in accordance with another embodiment of the present invention.

In FIG. 3, illustrated is a side view of a water-proof cover for the spreader 24.

Figure 4:
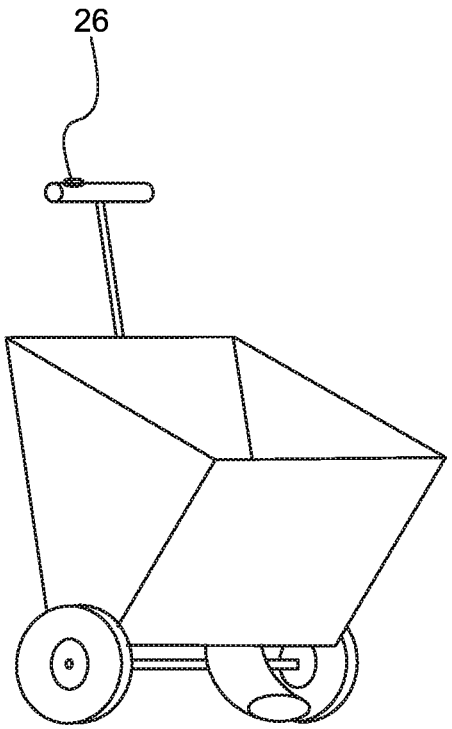
FIG. 4 illustrates a side view of an absorbent spreader, in accordance with another embodiment of the present invention.

Referring now to FIG. 4, illustrated is a side view of an absorbent spreader 5, in accordance with another embodiment of the present invention.

In FIG. 4, illustrated is a side view of an absorbent spreader 5, with a release button 26 that is positioned on the handle grip. The release button is configured to discharge the absorbent through the chute.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention.

What is claimed is:

1. A device for spreading absorbents, said device comprising:

a basket to contain the absorbents therein, said basket having an open top to receive absorbents therein;

a chute disposed on at least a portion of a center point on a front end of a bottom surface of the basket to dispense the absorbents therefrom, such that from a first end of the chute, the chute protrudes from the front end of the bottom surface of the basket, curving downward and away from the basket, towards a second end, such that the second end is near a ground surface;

a plurality of wheels, such that the chute curves away from the plurality of wheels;

a brush disposed between the plurality of wheels to spread the absorbents, such that the second end of the chute is in front of the brush and the plurality of wheels;

legs;

a release button; and at least one handle.

2. The device according to claim 1, wherein said release button is positioned on the at least one handle.

3. The device according to claim 1, wherein said chute is configured to allow the absorbents to flow through.

4. The device according to claim 2, wherein said basket is configured to hold the absorbents.

5. The device according to claim 2, wherein said plurality of wheels facilitates movement of said device.

6. The device according to claim 1, wherein said legs are configured to prevent movement of said device when said device is not in operation.

7. The device according to claim 2, wherein said release button is configured to discharge the absorbent through the chute.

* * * * *